United States Patent [19]

Tolfsen

[11] Patent Number: 4,670,951

[45] Date of Patent: Jun. 9, 1987

[54] FASTENING MEANS FOR A SAFETY BELT FOR A CAR OR THE LIKE

[75] Inventor: Ulf Tolfsen, Fredrikstad, Norway

[73] Assignee: Loyds' Industri A.S., Fredrikstad, Norway

[21] Appl. No.: 867,585

[22] Filed: May 27, 1986

[30] Foreign Application Priority Data

May 24, 1985 [NO] Norway ..... 852097

[51] Int. Cl.[4] ..... A44B 11/26

[52] U.S. Cl. ..... 24/637; 24/639; 24/641

[58] Field of Search ..... 24/639, 633, 637, 640, 24/641, 642, 644, 652

[56] References Cited

U.S. PATENT DOCUMENTS

| | | | |
|---|---|---|---|
| 3,353,234 | 11/1967 | Settimi | 24/637 |
| 3,935,618 | 2/1976 | Fohl | 24/639 |
| 4,000,548 | 1/1977 | Stephenson et al. . | |
| 4,450,604 | 5/1984 | Oowada | 24/641 |
| 4,454,634 | 6/1984 | Haglund et al. | 24/641 |
| 4,587,696 | 5/1986 | Ueda et al. | 24/637 |

FOREIGN PATENT DOCUMENTS

| | | | |
|---|---|---|---|
| 2263955 | 7/1974 | Fed. Rep. of Germany | 24/641 |

*Primary Examiner*—Victor N. Sakran

*Attorney, Agent, or Firm*—Browdy and Neimark

[57] ABSTRACT

A fastening means for a safety belt of a car or the like comprises an insert member secured to said belt, a locking opening in said insert member, a locking case member having an opening for receiving said insert member, a spring loaded locking member in said locking case member for cooperation by engagement with said locking opening and for keeping said insert member in the locking case member, a release member that is able to guide the locking means to release the insert member against a spring load, a blocking means for keeping said locking means in cooperating engagement with said locking opening, and an expeller for said insert member. The spring loaded locking means is a bolt mounted in the locking case member for displacement across an opening in the locking case member. On both sides of opening contact surface for bolt are provided in locking case member to hold it firmly in the direction of force of the safety belt. Said locking case member is pivotally mounted in the vehicle about an axis normal to the longitudinal axis of the locking bolt.

7 Claims, 4 Drawing Figures

FASTENING MEANS FOR A SAFETY BELT FOR A CAR OR THE LIKE

FIELD OF THE INVENTION

The present invention relates to a fastening means for a safety belt of a car or the like, comprising an insert member being attached to said belt, a locking recess in said insert member, a locking case member having an opening for receiving said insert member, a spring loaded locking member in said locking case member for cooperation with said locking recess and for holding said insert member in the locking case member, a release member capable of camming said locking member against said spring load for releasing said insert member, a blocking member for retaining said locking member in engagement and cooperating with said locking recess, and an expeller for said insert member.

BACKGROUND OF THE INVENTION

Research of late years has shown that in cases of extreme loads on a fastening means for safety belts there may be forces and oscillation phenomena which conventional fastening means of safety belts cannot withstand. Measurements in connection with collision tests, thus, show very high g-loads, and it was also established that the components may oscillate separately to such an extent that the mechanism is released.

SUMMARY OF THE INVENTION

On the basis of this recognition a new and improved fastening means for safety belts of cars and the like is, thus, provided according to the present invention. By the aid of this improved safety means a very reliable connection is achieved between the insert member and the locking case member, and unintenional release is prevented, also, said fastening means must, of course, be intentionally releasable by the exercise of a weak release force.

This is achieved with a fastening means of the initially mentioned kind by designing the spring loaded locking member as a bolt mounted in said locking case member for displacement across said opening of the locking case member, and by providing abutment surfaces for the bolt so as to restrain said bolt in the direction of force of said safety belt at both sides of the opening of said locking case member.

By the aid of this invention a bolt-fork-connection is achieved between the insert member and said locking case member, i.e. a very simple connection without any hazard of breaking anything and without any detrimental bending momentum. When the locking case member is secured to the vehicle so as to be pivotal about an axis normal to the length axis of said bolt, said fastening means will show great capacity of orienting in the direction of force and, thus, the fastening means will have the necessary degrees of freedom for a transmission of force without breakage or bending momentum.

Preferably, the expeller comprises a spring loaded memember extending into the space of displacement of said bolt when the bolt is retracted from the opening of the locking case member.

Said blocking means preferably comprises a member mounted in said locking case member in a coulisse guide means and cooperating with said bolt by engagement and with said expeller by camming.

According to the present invention said cam gear may, advantageously comprise a blocking portion for the coulisse block. By the aid of said blocking portion said blocking means is kept in an active condition until said fastening means is to be opened by said release member.

For instance, in a collision involving great forces where oscillation phenomena are to be expected as well, the release member might be influenced to such a degree that it will tend to release the fastening means. It is, thus, proposed to provide a manually operated safety means for the bolt.

Additionally, or in stead of a manually operated safety means there may, advantageously, be provided a safety means for the bolt that may be influenced by g-forces, i.e. a safety means reacting when the safety means is subjected to great shock effects and there is a hazard that the release member be influenced to release. This safety means may, e.g. be a pin that is maintained in a free position by a weak spring and is provided directly opposite to a recess in said bolt when said bolt is in its blocking position.

In an advantageous practical embodiment said locking case member is made of a plate bent into a U-shape with an opening provided in the bottom of the U. The blocking arrangement comprises a pin slidably mounted in groves in the flanks of said U. The release member is advantageously shaped as a relatively light-weight member having a substantially U-shaped cross section and being pivotally mounted in said locking case member, and having flanks extending along the flanks of said locking case member, each release member flank having a recess shaped as a cam guide for the blocking pin. In case of a swinging movement of the release member, said release member will, thus, be cam guided to movement in the grooves in said locking case member, and will take the bolt along.

DESCRIPTION OF THE DRAWINGS

The advantages of the invention as well as further details will be disclosed in connection with the following description of a preferred practical embodiment of a safety means according to the invention with reference to the drawing, where.

Figure 1:
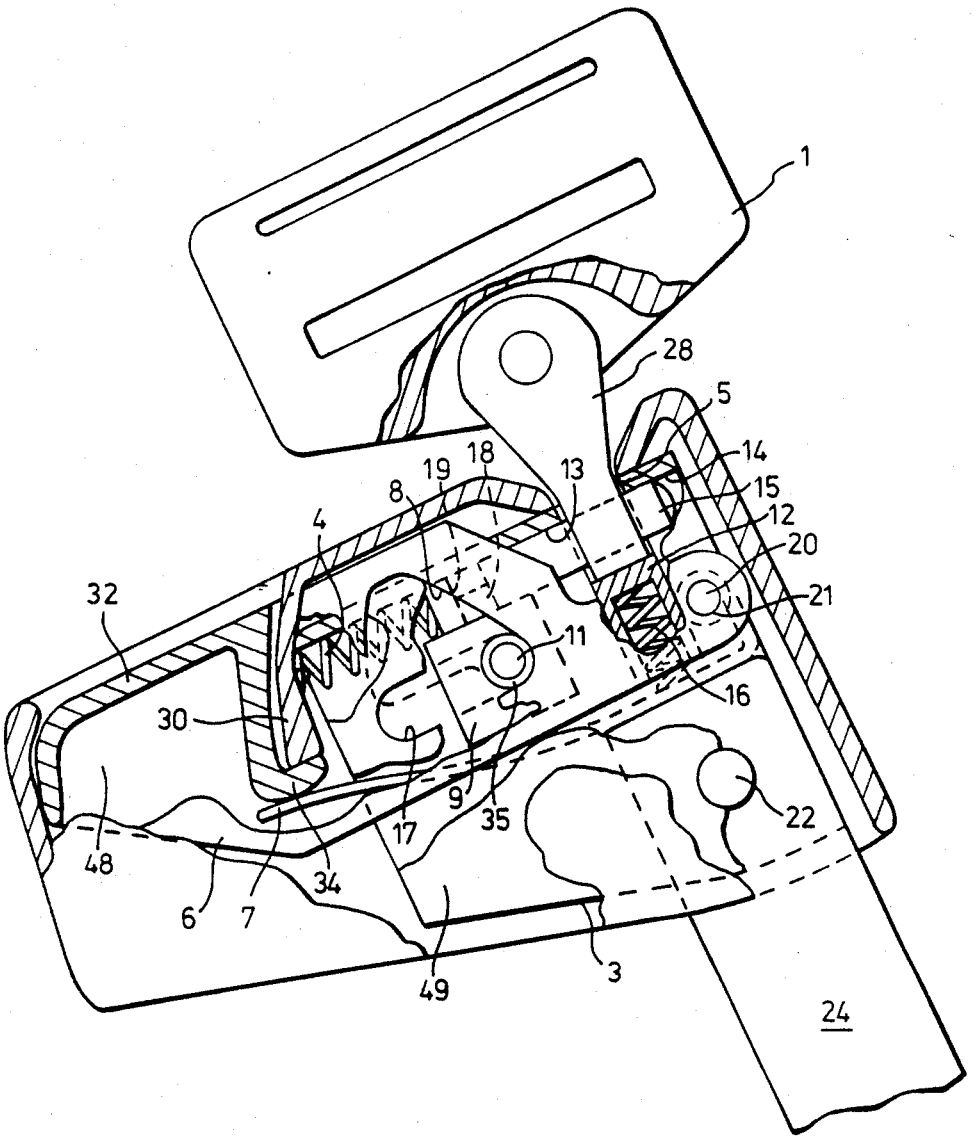
FIG. 1 shows a safety means, partly in section.

The main components of the safety means are insert member 1 and locking case member 3. By the aid of a bolt 22 locking case member 3 is pivotally connected with a shank 24 firmly secured to the vehicle. Shank 24 has an opening 23 that is aligned with openings 27 in locking case member 3, said shank and locking case member, as mentioned, being locked together by bolt 22 that is inserted in openings 23, 27.

Locking case member 3 is designed as a plate bent to U-shape. In the bottom of the U an opening 5 is provided. Said opening 5 is dimensioned for insertion of a yoke-shaped part 28 on insertion member 1. Said yoke-shaped member 28 forms a locking opening 2. When said yoke-shaped member 28 is inserted in opening 5 in locking case member 3 said locking opening 2 will be placed inside locking case member 3, on the inside of the U-bottom, and a bolt 15 can be inserted into locking opening 2 and, thus, lock together the insert member and the locking case member (see FIG. 1). On both sides of opening 5 in locking case member 3 the bottom of the U will form a contact surface 13, 14 respectively for the bolt 15.

Locking case 3 is provided inside a case 25. Said case is provided with an insertion opening 26 for the yoke 28 of the insertion member, and it is provided with an opening 29 from one lateral edge of which a tongue 30 is bent down and into said case to form an abutment for a spring 4 acting on bolt 15.

In the plate bent into a U-shape and forming the locking case member 3 an opening 31 is provided in each of the flanks where a bolt 20 may be inserted. A release member 6 shaped as a member having a substantially U-shaped cross section is pivotally mounted in locking case member 3 by the aid of openings 21 provided in its flanks. Said bolt 20 also passes through openings 21 in the release member. Release member 6 is provided with a web portion 32 which will be placed in said opening 29 in case 25 (FIG. 1) when the release member is mounted. On bolt 20 a release spring 7 is mounted and acts against a lug 34 provided in release member 6 to urge said release member, i.e. its lug 34 towards flap 30 projecting into said case. In each flank of locking case member 3 a coulisse groove 17 is provided, and a blocking slide 9 has a bore 33. Said blocking slide 9 is arranged inside locking case member 3 and is mounted there by the aid of a bolt 11 passing through said coulisse grooves 17 and through bore 33 in blocking slide 9. Said blocking slide 9 has a small pin 18 extending into a bore 19 in locking bolt 15.

In each flank of the release member 6 a cam guide opening 8 is provided. On bolt 11 a roller 35, 36 resp. is provided outside locking case member 3. Each roller cooperates with a cam guide opening 8.

Figure 2:
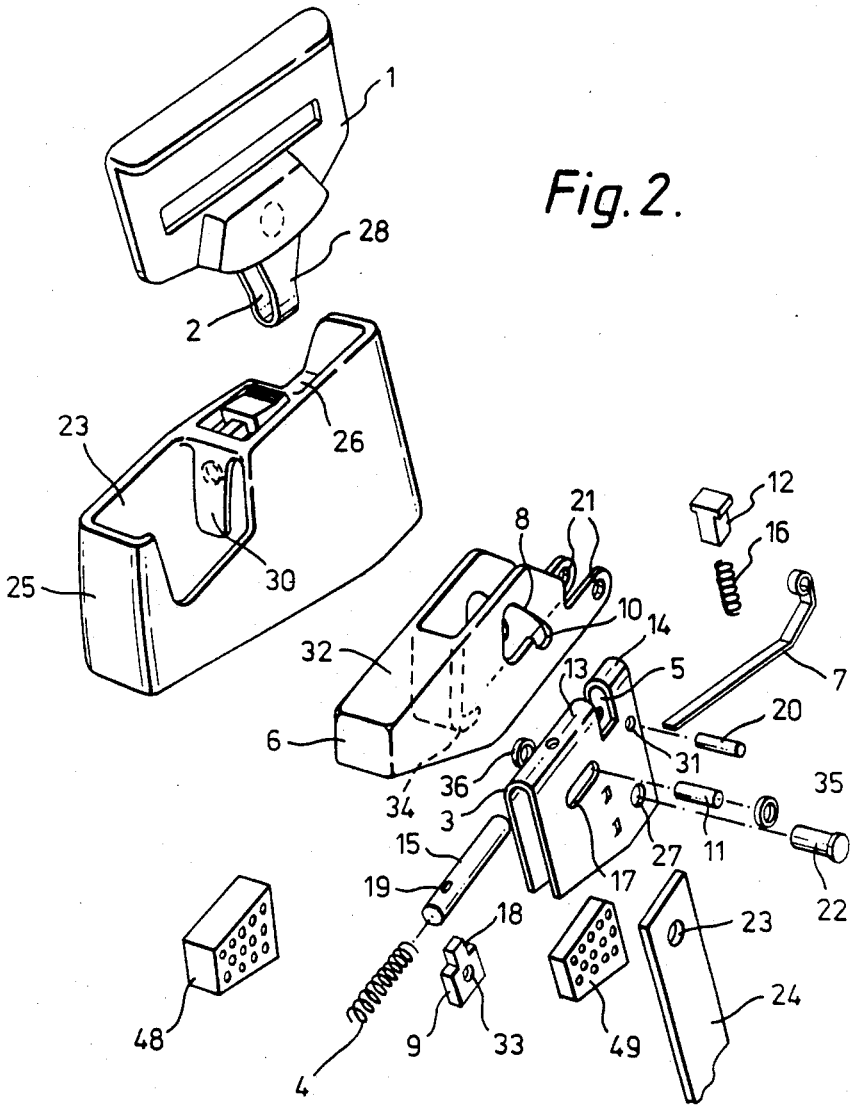
FIG. 2 is an exploded view of the safety means as shown in FIG. 1.

An expeller 12 is placed inside locking case member 3. Expeller 12 is shaped as a substantially prismatic body provided with a blind bore in which a spring 16 is provided resting on the bottom of said blind bore and abutting against shank 24 (FIG. 1). The spring 16, thus, urges the expeller 12 towards the yoke member 28 in the locked position shown in FIG. 1. When insert member 1 and its yoke member 28 are not inserted into locking case member 3, the expeller 12 will be urged upwards by spring 16 and lie in the displacement path of locking bolt 15 so that locking bolt 15 is maintained in a retracted position leaving opening 5 in locking case member 3 free, i.e. open, so that the yoke member 28 may be inserted. The fastening means disclosed above operates as follows: In FIG. 1 insert member 1 is inserted into locking case member 3 and the fastening means is active, said locking bolt 15 locking together insert member 1 and locking case member 3. The insert member is also locked to shank 24 and, thus, to a fixed point of the vehicle. When said fastening means is to be released release member 6 is depressed a pressure being exerted on web portion 32 so that the release member will swing counterclockwise about bolt 20. Cam guide openings 8 will cooperate with the rollers 35 on bolt 11, so that said bolt 11 is displaced to the left in FIG. 1 in coulisse grooves 17 provided in locking case member 3. Bolting slide 9 with its pin 18 engaging the through bore 19 in locking bolt 15 will follow the movement of bolt 11 to the left. The bolting slide will, thus, take along locking bolt 15 against the effect of locking bolt spring 4. Yoke member 28 is finally released and insert member 1 (end the belt, not shown) is then free. Insert member 1, i.e. its yoke member 28 is pushed out of locking case member 3 and its case influenced by expeller 12, the spring of which is supported by shank 24. Locking bolt 15 now cannot go back into a bolting position because expeller 12 will prevent this. The expeller 12 is provided with a small head, as shown in FIG. 2, which is guided by opening 5 in locking case member 3. The opening movement by release member 6 is carried out against the action of release spring 7. Cam guide opening 8 is provided with a blocking portion 10 holding bolt 11 in its active position shown in FIG. 1. When release member 6 is turned counterclockwise to release the fastening means, said blocking portion 10 will be removed from the path of the bolt 11 in coulisse grooves 17. When the fastening means is to be activated again yoke member 28 is inserted into the position shown in FIG. 1 against the action of expeller 12 and its spring 16. Spring 4 of locking bolt 15 will then cause said locking bolt to enter opening 2 in yoke member 28 to the bolting position shown in FIG. 1. At the same time blocking slide 9 will move towards the right as a consequence of the cooperation between pin 18 of the blocking slide and bore 19 in locking bolt 15. Thus, bolt 11 is moved to the right side in FIG. 1 and will, finally, move down to the right of blocking portion 10 in cam guide opening 8. Release member 6 is now released to swing clockwise, influenced by its spring 7, and member 6 moves to the position shown in FIG. 1. In this manner a visual indication of the fact that the fastening means is activated is provided.

Figure 3:
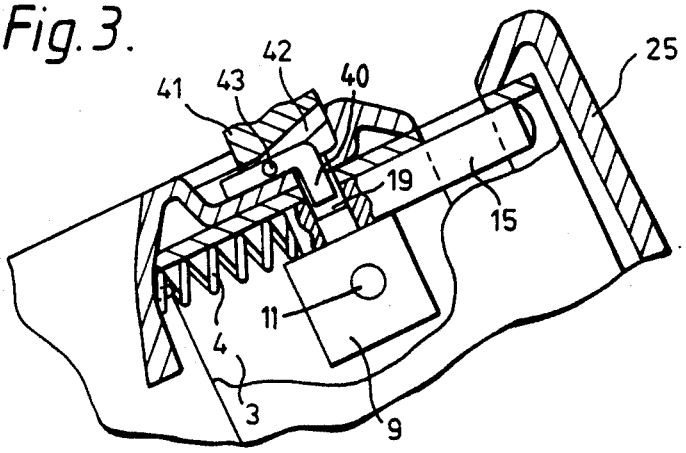
FIG. 3 shows a portion of said safety means with a manually operated safety means for the bolt.

Release member 6 is made as light-weight as possible, preferably from a suitable plastic material, so that the release member has low inertia and, thus, will not be able to release unintended when influenced by the forces, e.g. arising in case of a car crash. For an additional safety means a manual blocking arrangement may be used, as shown in FIG. 3. Here, a blocking lug 40 extends through an opening in the bottom of locking case member 3 and into bore 19 in locking bolt 15. Said blocking lug 40 is kept in a blocking position by the aid of a displaceable knob 41 provided with a groove 42 which cooperates with a small control boss 43 on blocking lug 40. When knob 41 is moved to the left in FIG. 3 boss 43 will file in groove 42 and pull blocking lug 40 out of engagement with bore 19 in locking bolt 15.

Figure 4:
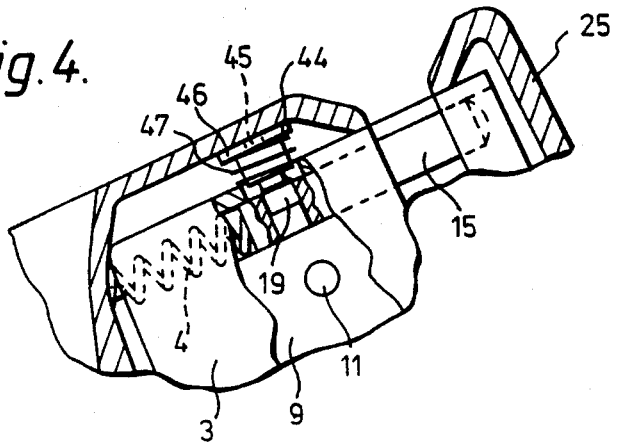
FIG. 4 shows a corresponding portion with a safety member for the bolt that is influenced by g-forces.

An approach that may be better is shown in FIG. 4, where a blocking pin 44 is provided directly outside bore 19 in locking bolt 15. Said blocking pin has a head 46 that is influenced by a weak spring 47 acting between said head 46 and locking case member 3. Blocking pin 44 controls a small control pin 45 provided inside case 25 and shown with dashed lines. Spring 47 keeps blocking pin 44 out of engagement as regards bore 19. When a sufficiently great g-force occurs said blocking pin 44 consisting of a suitable relatively heavy material will, however, overcome the force of spring 47 and engage with bore 19, thus, to block locking bolt 15. Said blocking pin 44 will react more rapidly than release member 6 under the same g-force load.

In FIG. 2 two filling elements 48, 49 are shown. These elements may consist of a suitable compressible material and are intended for placing in the areas indicated by the same reference numbers in FIG. 2. The object of these insert elements is only to enhance the ability of said fastening means to withstand compressional forces in a plane normal to that of the paper.

Having described my invention, I claim:

1. A fastening means for a safety belt for a vehicle comprising an insert member secured to said belt, a locking opening in said insert member, a locking case member having an opening for receiving said insert member, a spring loaded locking means in said locking case member for cooperation by engagement with said locking opening and for holding said insert member inside the locking case member, and a release member which is able to cam guide said locking means against a spring load to release the insert member, a blocking means for holding said locking means in cooperating engagement with said locking opening, and an expeller for said insert member, wherein said spring loaded locking means is a bolt mounted in locking case member for displacement across said opening of locking case member, there being on both sides of said opening in said locking case member contact surfaces for said bolt to hold said bolt in the direction of force of the safety belt, said locking case member being pivotally mounted in the vehicle about an axis normal to the longitudinal axis of said locking bolt, and said expeller is a spring loaded member projecting into the path of displacement of said locking bolt when said locking bolt is retracted from the opening in locking case member.

2. A fastening means for a vehicle comprising an insert member secured to said belt, a locking opening in said insert member, a locking case member having an opening for receiving said insert member, a spring loaded locking means in said locking case member for cooperation by engagement with said locking opening and for holding said insert member inside the locking case member, and a release member which is able to cam guide said locking means against a spring load to release the insert member, a blocking means for holding said locking means in cooperating engagement with said locking opening, and an expeller for said insert member, wherein said spring loaded locking means is a bolt mounted in locking case member for displacement across said opening of the locking case member, there being on both sides of said opening in said locking case member provided contact surfaces for said bolt to hold said bolt in the direction of force of the safety belt, said locking case member being pivotally mounted in the vehicle about an axis normal to the longitudinal axis of said locking bolt, and said locking case member is provided by a plate bent into U-shape with said opening provided in the bottom of the U such that said blocking means comprises a pin that is slidably mounted in the groove of each of the U-flanks, and that said release member is a relatively light-weight member shaped with substantially U-shaped cross-section and pivotally mounted in said locking case member with its flanks extending along the flanks of said locking case member, each flank of said release member having a recess shaped as a cam guide for said blocking pin, so that said blocking means with a swing movement of said release member will be cammed into movement in the grooves of locking case member and will bring along said locking bolt.

3. A fastening means for a safety belt for use in a vehicle and comprising:

an insert member secured to said belt;

a locking opening in said insert member;

a locking case member comprising a plate member bent into U-shape and having two sides and a U-bottom, an opening in the U-bottom for receiving said insert member with locking opening;

a locking bolt mounted in the locking case member for axial displacement in a direction along said U-bottom across said receiving opening;

a spring acting against said locking bolt to bring about its displacement across said receiving opening;

said locking case member being pivotally mounted in the vehicle about an axis extending perpendicular to the displacement direction;

each plate member side having a groove;

a blocking means including a pin engaging said locking bolt and being slidably mounted in said grooves, and a release means comprising a relatively light-weight member shaped with substantially U-shaped cross section and having flanks extending along the sides of the locking case member, said release member being pivotally mounted on said locking case member, each flank of said release member having a recess shaped as a cam guide for said blocking means, so that said blocking means upon a swing movement of said release member will be cammed into movement in said grooves and will bring along said locking bolt.

4. The fastening means of claim 3 wherein said cam guide includes a blocking portion.

5. The fastening means of claim 3 further including a manually operated safety means for said locking bolt.

6. The fastening means of claim 3 wherein a safety means influenced by gravity forces is provided for said locking bolt.

7. The fastening means of claim 3 wherein said safety means is a pin maintained in a released position by a weak spring and placed directly opposite a recess in said locking bolt when said locking bolt is in its blocking position.

* * * * *